US005675954A

United States Patent [19]

Garcia

[11] Patent Number: 5,675,954

[45] Date of Patent: Oct. 14, 1997

[54] ROOF OR WALL TILES MADE FROM RECYCLED RUBBER TIRES

[76] Inventor: Eduardo Daniel Garcia, Larrea 910 1* D, Buenos Aires, Argentina, 1117

[21] Appl. No.: 612,477

[22] Filed: Mar. 7, 1996

Related U.S. Application Data

[63] Continuation of Ser. No. 365,805, Dec. 29, 1994, abandoned.

[30] Foreign Application Priority Data

Dec. 30, 1993 [AR] Argentina ..... 327092

[51] Int. Cl.[6] ..... E04D 1/10

[52] U.S. Cl. ..... 52/518; 52/530; 52/543; 52/745.19; 52/DIG. 9; 29/401.1; 29/403.1

[58] Field of Search ..... 52/518, 543, 745.19, 52/DIG. 9, 530; 29/401.1, 403.1; 264/157, 159, 322, 346; 83/920, 951

[56] References Cited

U.S. PATENT DOCUMENTS

| | | | |
|---|---|---|---|
| 3,617,329 | 11/1971 | Goff | 117/27 |
| 3,803,792 | 4/1974 | Fulton | 52/DIG. 9 X |
| 4,914,994 | 4/1990 | Barclay | 83/951 X |
| 5,086,552 | 2/1992 | Moore | 52/DIG. 9 X |

*Primary Examiner*—Christopher Todd Kent

*Attorney, Agent, or Firm*—Jacobson, Price, Holman & Stern, PLLC

[57] ABSTRACT

A tile obtained from recycling worn rubber tires of automobiles. The tire is chopped into lengths of about 10" to 16" and then about 4" is lopped off the two side rim parts. The outer surface of the remaining central rolling tread part is run down to make it smooth and even and the tile is heated to between 210 ° and 300 ° F. for about one-half hour to straighten the longitudinal curvature. The cross curvature is maintained for a colonial type tile aspect.

9 Claims, 1 Drawing Sheet

ROOF OR WALL TILES MADE FROM RECYCLED RUBBER TIRES

This is a continuation of application Ser. No. 08/365,805, filed Dec. 29, 1994 which was abandoned upon the filing hereof.

FIELD OF THE INVENTION

The instant invention concerns a tile for topping roofs or covering walls of buildings. More particularly, the invention concerns rubber tiles of special elastomeric qualities having lasting efficiency and durability. The tiles of the invention may be used as roof elements on houses, huts, shops, garages and other domestic dwelling sites as well as for providing protective coverage for depots, tanks, silos and so on.

The instant invention also concerns a useful and practical method for recycling automobile wheel tires. The invention may also be adapted to recycling other discardible rubber and elastomeric material such as used conveyor belts and the like. More particularly, the method is related to adapting worn out radial type tires to produce tiles useful in the building industry.

BACKGROUND OF THE INVENTION

The most popular and attractive way of finishing off a roof is by means of tiles affixed to a base or next-inward roof layer structure such as a sloping wooden framework supported by rafters. The tiles provide an appropriate defence against weather conditions, both sunny and stormy. In particular, the roof tiles should be able to resist heat, rain, hail, snow, wind and sand storms without damage or tearing off. An important property of the roof element material is thermal isolation, i.e. the ability to keep sun heat out in summer and interior warmth inside in winter.

The building, roof rafters and, specially, the wooden framework forming the next-inward roof structure should bear the weight of the tiles thereon. The tile arrangement and outer surface should further discourage accumulation of dust, earth and leaves which add weight and may lead to leaks in rainy weather.

From an architectural point of view, types of tiles are also selected for aesthetic reasons. The so-called colonial tile is a popular choice with some people.

Automobile tires need to be replaced every few ten thousand miles, whereafter the discarded tires usually end up being burned or buried. One way or the other, they represent an environmental contamination problem.

SUMMARY OF THE PRIOR ART

Tiles are classically made of ceramic material. Other forms of sloping roof coverage make use of cement or tin corrugated sheets, generally in low-cost housing and industrial buildings where economy takes precedence over beauty.

Such roof elements are generally made from new raw material which therefore represents an added cost. Ceramic tiles are usually affixed by wires to the wooden framework, which is a relatively time consuming and hand-labour intensive activity.

Tin roofing provides very poor thermal isolation and, moreover, is terribly noisy in hail storms. Classes have been known to have been halted because of the din in tin-roofed shools during heavy rain or hail storms. Ceramic tile and cement sheet roofing provide better thermal and acoustic isolation, although they may not be all that silent for that matter in heavy weather conditions. In other extreme weather conditions, like hurricanes for instance, the above roof elements have been known to fly off and are dangerous if they should happen to hit or fall on top of someone.

I have no knowledge of prior art procedures for obtaining tiles from rubber tires. In fact, I have never seen roofs made from rubber tiles. I have reviewed various patents on rubber tire processes, such as Argentine patents 218,470, 222,542 230,210, 231,816, 233,298, 239,511, 240,418, 240,884 and 242,145 but they all refer to either reducing or recapping worn out tires, but none suggest giving a different, useful purpose to make good use of discarded rubber tire material in a different field of activity.

SUMMARY OF THE INVENTION

At first glance, rubber tiles seem to offer a range of advantages, such as good heat isolation, excellent acoustic isolation, easy to nail onto wooden panels of the roof framework or rafters, generally somewhat lighter than other roof materials, far less dangerous in high wind conditions, and may be made with a slippy top or outer surface not prone to retaining dust, dirt and leaves.

Moreover, if the rubber material of the tiles may be had from expended articles of other fields of activity, and the cost of recycling compares favourably with the cost of prime raw material of other new roof elements, then the production of tiles from used tires may also be economically advantageous, in addition to ecological benefits from the point of view of the discarded waste of tires that have already exhausted there useful life-span in motor-cars, buses, trucks, tractors and other vehicles.

Therefore, it is an object of the present invention to produce a rubber or elastomeric tile providing the above advantages for building roofs or walls.

Another object is to produce a tile made from used automobile wheel tires.

Yet another object is to economically recover the material of spent automobile wheel tires for a useful purpose.

A further object of the invention is to devise a simple and economical method of recycling curved rubber articles for use as tiles in the building industry.

Still another object of the invention is to reduce rubber tire waste contaminating our environment.

The method of the present invention comprises transversely chopping a rubber cylindrical article, such as a tire and preferably a discarded worn out radial automobile tire, into arcuate sections, preferably between 10" and 16" long, and heating said arcuate sections sufficiently, e.g. to a temperature somewhere between 210° F. and 300° F., to substantially straighten the section longitudinally. In the case that the starting article is a rubber tire, the rim parts, preferably about 4", are longitudinally cut off on both sides leaving the useful central band the outer surface of which, that is the former rolling tread, may be levelled down to remove rough or uneven portions. The transversal curvature of the rolling band part is preferably left unmodified.

The present invention also concerns a tile obtained from a rubber tire or the like using the above method and a roof made from such tiles. Preferably, the tile has a colonial type shape, is of rubber material including an inner metallic layer for reinforcement and has a smooth and even outer surface.

According to an alternative embodiment for obtaining a tile more economically or differently shaped, the aforesaid step of straightening the section is bypassed to produce a "humped-back" tile.

BRIEF DESCRIPTION OF THE DRAWINGS

The above-stated and other novel features and aspects of this invention and its reduction to practice may be understood better from the following detailed description of a preferred embodiment shown in the attached drawings, wherein.

DETAILED DESCRIPTION OF A PREFERRED EMBODIMENT

Figures 1, 2, 3, 4:
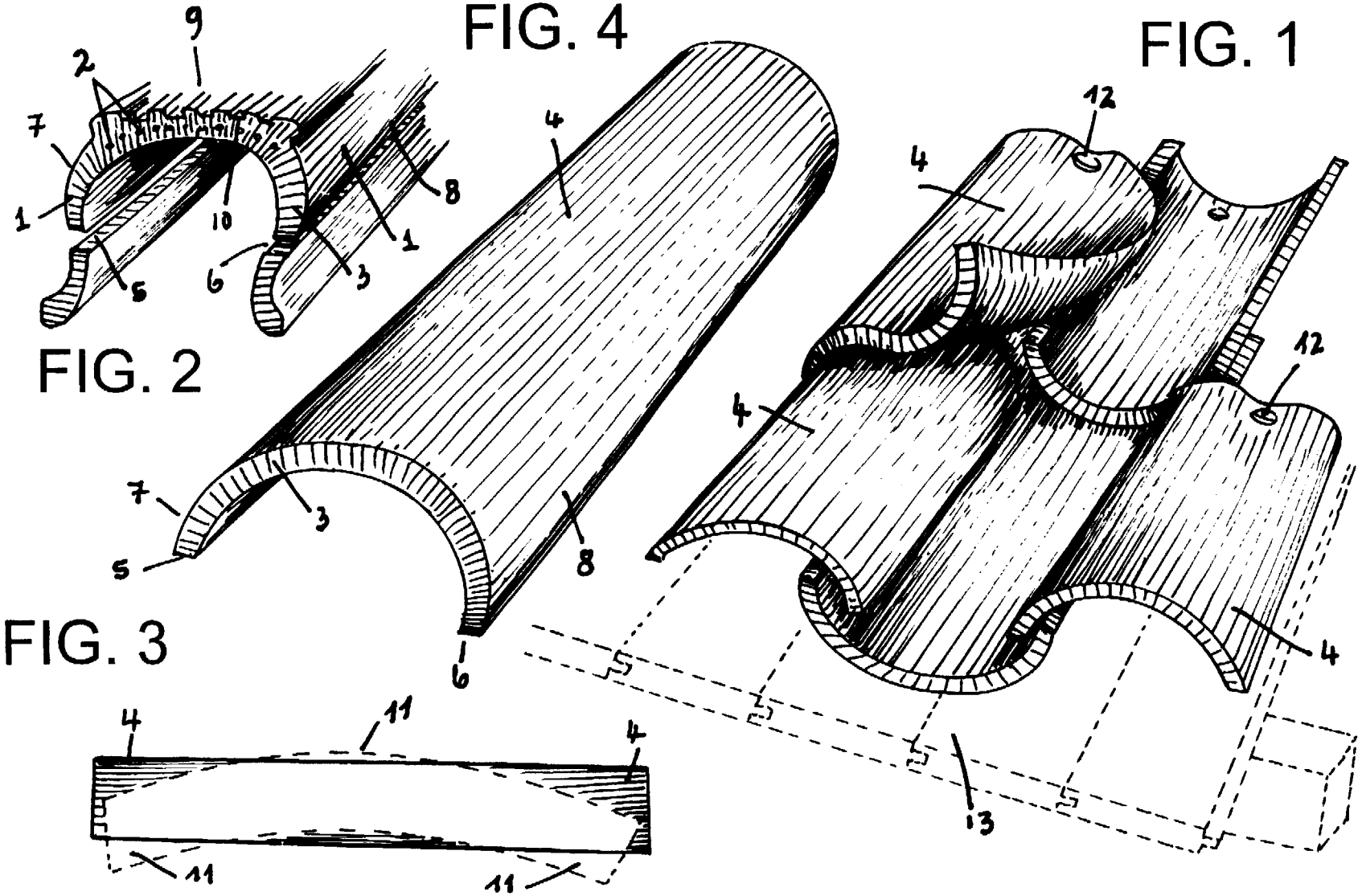
FIG. 1 illustrates part of a tiled roof similar to a conventional roof made of colonial tiles but using rubber tiles according to the present invention.
FIG. 2 is a perspective view of one section cut off from a rubber tire showing how the two rim parts are longitudinally cut off, to separate the central rolling tread section for use as a preform for further processing according to the present invention.
FIG. 3 is a side view of the tile preform obtained from the tire section of FIG. 2 and showing the change of shape after being subjected to the heating process forming part of the method of the present invention.
FIG. 4 is a perspective view of the finished tile product obtained from the tire section of FIG. 2 and which may make up the roof of FIG. 1.

The illustrated preferred embodiment of the present invention briefly comprises arranging used or discarded automobile radial-type tires 1 having an inner reinforcement layer formed of a metallic structure 2. As illustrated in FIG. 2, the first step of the method is to transversely chop off, as indicated by reference numeral 3, an approximately rectangular section 4 of between 10" and 16" long (arcuate length) and the width of the tire, using a guillotine or a press with a cutting edge.

The section 4 is then subjected to a thermal treatment process in an autoclave or a kiln, wherein it is heated to a temperature of between 210° F. and 300° F. for about a one-half hour, to rectify the longitudinal curvature 11 of the rubber tire, as illustrated by the side view of FIG. 3. About 4" up from each rim is cut off, as indicated by reference numerals 5 and 6 in FIG. 2, from both sides of the tire section 4, using conventional derimmer machinery, so that the tile 4 thus formed has a colonial style shape.

Thereafter, the rolling band 9 is preferably levelled down to remove the tread and hence even out the back surface 10 of the tile to provide a smooth concave outer surface, as illustrated in FIG. 4.

Referring to FIG. 1, the tiles 4 may be easily assembled and affixed to a wooden framework base, rafters or beams to build a roof by means of stainless steel or brass nails, for instance. The lightness and flexibility of the tiles 4 help to make the job easier and the novel process of nailing the tile is simpler than the conventional process of wiring ceramic tiles.

I have found that about 130 sq.ft. of roof surface may be covered with about fifty tires of the size for a medium sized motor-car. In case of roofs having a plurality sloping surfaces, the rubber tiles 4, transversely placed, may be also use to cover roof apices or junctions (not shown) between two different sloping roof surfaces. Thereafter, the outer tile surface may be covered by tar disolved in kerosene to give it a final, uniform finishing touch.

Referring back to the method of FIGS. 1 to 3, other back-straightening procedures may be used instead of the heating step described hereinabove. According to an alternative embodiment of the invention, the straightening-by-heat step is bypassed completely such that the tile is left with a longitudinal curvature. This reduces the production cost of the tile. Furthermore, such "humped" tiles provide a better grip when assembled on a roof. Moreover, a humped tile roof is by no means unattractive in the aesthetic sense and provides an architecturally interesting variant.

The industrial usefulness of the present invention is essentially twofold. It provides a simple and economical way of producing efficient tiles and, collaterally, makes a beneficial contribution to the industrial waste and contamination problem, by enabling the material of rubber tires to be recovered, thereby avoiding having them burned or buried.

Of course, other changes, variations and aggregations may be applied to the above-detailed embodiment, without departing from the scope nor the spirit of the invention. The same has been described specifically by way of a preferred embodiment, however those skilled in the art may suit it to other applications without departing from the purview of the invention as set forth in the appended claims. For instance, other tile lengths are within the purview of the invention. In fact, each tire could be submitted to just one transversal cut to produce a "long" tile, that is wherein the length thereof is the starting circumpherence of the tire.

I claim:

1. A method for obtaining tiles of a predetermined length from a rubber cylindrical article, comprising the steps of: transversely chopping the article into arcuate sections approximately the length of said predetermined length and later heating said arcuate sections sufficiently to substantially straighten the sections longitudinally.

2. The method of claim 1, wherein said heating step comprises heating said sections to a temperature between 210° F. and 300° F.

3. The method of claim 2, wherein said heating step lasts about one-half hour.

4. The method of claim 1, wherein the article is a rubber tire including a central rolling tread part and a rim part on each side thereof, said method further comprising the step of longitudinally cutting the rim parts off both sides of said tire.

5. A tile formed by the process transversely chopping an arcuate section of predetermined length from a rubber cylindrical article, wherein said arcuate section is heated to a temperature between 210° F. and 300° F. for about one-half hour to substantially straighten said arcuate section longitudinally.

6. The tile of claim 5, wherein said tile is made from an automobile tire and is made of rubber including an inner metallic reinforcement layer.

7. A roof including a base surface and a plurality of tiles affixed to said base surface and made from a plurality of rubber cylindrical articles by transversely chopping respective arcuate sections of a predetermined length off said articles, said arcuate sections having been longitudinally straightened by hating so that said plurality of tiles are longitudinally straight and transversely curved.

8. The roof of claim 7, wherein said sections are heated to a temperature between 210° C. and 300° C. for about one-half hour.

9. The roof of claim 7, wherein said articles are automobile tires and the tiles thereof are made of rubber including inner, metallic reinforcement layers.

* * * * *